US007207422B2

(12) United States Patent
Takeuchi

(10) Patent No.: US 7,207,422 B2
(45) Date of Patent: Apr. 24, 2007

(54) ELEVATOR CALL RECORDING DEVICE

(75) Inventor: Nobukazu Takeuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 333 days.

(21) Appl. No.: 10/516,101

(22) PCT Filed: Apr. 1, 2003

(86) PCT No.: PCT/JP03/04184

§ 371 (c)(1),
(2), (4) Date: Nov. 30, 2004

(87) PCT Pub. No.: WO2004/089800

PCT Pub. Date: Oct. 21, 2004

(65) Prior Publication Data

US 2005/0252723 A1 Nov. 17, 2005

(51) Int. Cl.
*B66B 1/34* (2006.01)

(52) U.S. Cl. ..... 187/391; 187/901

(58) Field of Classification Search ..... 187/391–399, 187/901; 340/691.6, 691.7, 539.18, 539.11, 340/286.11, 825.19
See application file for complete search history.

(56) References Cited

U.S. PATENT DOCUMENTS 5,311,175 A * 5/1994 Waldman ..... 341/34
6,550,586 B1 4/2003 Takeuchi
6,696,962 B2 * 2/2004 Kelly ..... 340/612
6,828,918 B2 * 12/2004 Bowman et al. ..... 340/825.19
6,902,041 B2 * 6/2005 Eccleston ..... 187/380
6,941,068 B2 * 9/2005 Matsuda ..... 396/91

FOREIGN PATENT DOCUMENTS

| | | | |
|---|---|---|---|
| JP | 58-82967 | A | 5/1983 |
| JP | 99266/1983 | | 7/1983 |
| JP | 4-223981 | A | 8/1992 |
| JP | 8-143238 | A | 6/1996 |
| JP | 11-21030 | A | 1/1999 |
| JP | 2000-128444 | A | 5/2000 |
| JP | 2000-335838 | A | 12/2000 |
| JP | 2001-2331 | A | 1/2001 |
| JP | 2002-53273 | A | 2/2002 |
| WO | WO 01/98192 | A1 | 12/2001 |

* cited by examiner

*Primary Examiner*—Jonathan Salata
(74) *Attorney, Agent, or Firm*—Sughrue Mion, PLLC

(57) ABSTRACT

An elevator call registration system is equipped with a touch panel display, and a processing operation section that registers an operation from the touch panel display into an elevator control unit. The processing operation section detects the position of a user's touch to a touch panel, ticks time in synchronization with the start of the touch to the touch panel, and measures the time ticked away. A prescribed first time limit and the measured time are compared with each other, and voice guidance related to the detected touch position is provided after the measured time exceeds the first time limit.

6 Claims, 4 Drawing Sheets

ELEVATOR CALL RECORDING DEVICE

TECHNICAL FIELD

The present invention relates to an elevator call registration system, and more particularly, to an elevator call registration system that provides voice guidance to visually handicapped persons.

BACKGROUND ART

As such a kind of conventional elevator call registration system, there has been known one in which in an automatic operation type elevator, a call registration device is equipped with a braille plate with braille representation capable of being operated by visually handicapped persons, and a sensor is attached to the braille plate for detecting that a human body touches or contacts the braille plate, so that the content of the braille on the braille plate thus touched or contacted is broadcast and guided, based on a detection signal from the sensor, with voice by means of a voice guidance device (for example, see Japanese patent application laid-open No. 9-110319).

In addition, an elevator operation control device has been known in which inside an elevator or at a hall side, there is installed an operation panel with operation buttons arranged thereon for instructing elevator operations, and which serves to recognize a visually handicapped person and switch the operation of the elevator into an operation mode for visually handicapped persons, so that when a hand touch to a face plate, on which the operation buttons are arranged, is detected, and when another hand touch (i.e., to a touch sensor) other than the hand touch to the face plate is detected, a visually handicapped person is recognized on the condition that an operation button is pushed within a predetermined period of time from such detection, and the determination of recognition is reset on the condition that there is no pushing operation (for example, see Japanese patent application laid-open No. 2001-2331).

However, recent elevator call registration systems are provided with a touch panel display in order to enhance the contents of guidance. For example, such a system includes a sensor that is installed on each hall of an elevator for detecting the walking speed of a user, a white cane, etc., a weak person determining section that determines, based on the detection result of this sensor, whether users include a weak person such as an old person, a visually handicapped person, etc., an announcement instruction section that increases the volume of an announcement in an elevator car and at the same time switches the content of the announcement when a weak person is detected by the weak person determining section, and a touch panel control section that improves the visibility and operability of a touch panel operation section in the car upon detection of the weak person by the weak person determining section. Moreover, the display size or contrast is intended to be increased for improved visibility of the touch panel operation section, the size of each button is increased to ease pressing for improved operability of the touch panel operation section, and minute or fine operation guidance is carried out for switching of the announcement content (for example, see Japanese patent application laid-open No. 2002-53273).

However, the conventional elevator call registration system equipped with the touch panel display, though including the weak person determining section for detecting visually handicapped persons, poses the following problems. That is, upon detection of a white cane or the like, those which resemble a white cane are detected by mistake, or detection is impossible at rush hours or crowded times, or voice guidance flows uselessly at the use of an able-bodied person.

Also, there are additional problems as stated below. When a quick trace is conducted by a user, or when touch is frequently repeated, a plurality of control contents are successively guided by voice, so that the user might easily make a mistake in recognizing an area to be operated, and noise in the surroundings of the elevator hall becomes large.

Accordingly, the object of the present invention is to provide an elevator call registration system in which when a visually handicapped person uses an elevator, a user's call can be registered by providing accurate voice guidance without especially installing any weak person determining section for detecting visually handicapped persons.

DISCLOSURE OF THE INVENTION

The present invention resides in an elevator call registration system which is equipped with a touch panel display serving for call registration in accordance with a touch position thereon, and a processing operation section for registering an elevator call into an elevator control unit based on an operation of a user on the touch panel display, characterized in that the processing operation section includes: a position information detection section that detects the position of a touch of the user to the touch panel display; a timer unit having a first timer section that counts time from the start of the touch to the touch panel display; a time measurement and comparison section that compares a count value of the first timer section with a prescribed time limit; a voice guidance section that serves to provide voice guidance related to the touch position detected after the time of the touch to the touch panel display exceeds the prescribed time limit; and a call registration section serving to register a call corresponding to the detected touch position into the elevator control unit when the time of the touch to the touch panel display is shorter than the time limit, and the call registration section also registering, after the voice guidance has been given, a call corresponding to the detected touch position into the elevator control unit when the time of the touch is longer than the time limit.

BEST MODE FOR CARRYING OUT THE INVENTION

Embodiment 1

Figure 1:
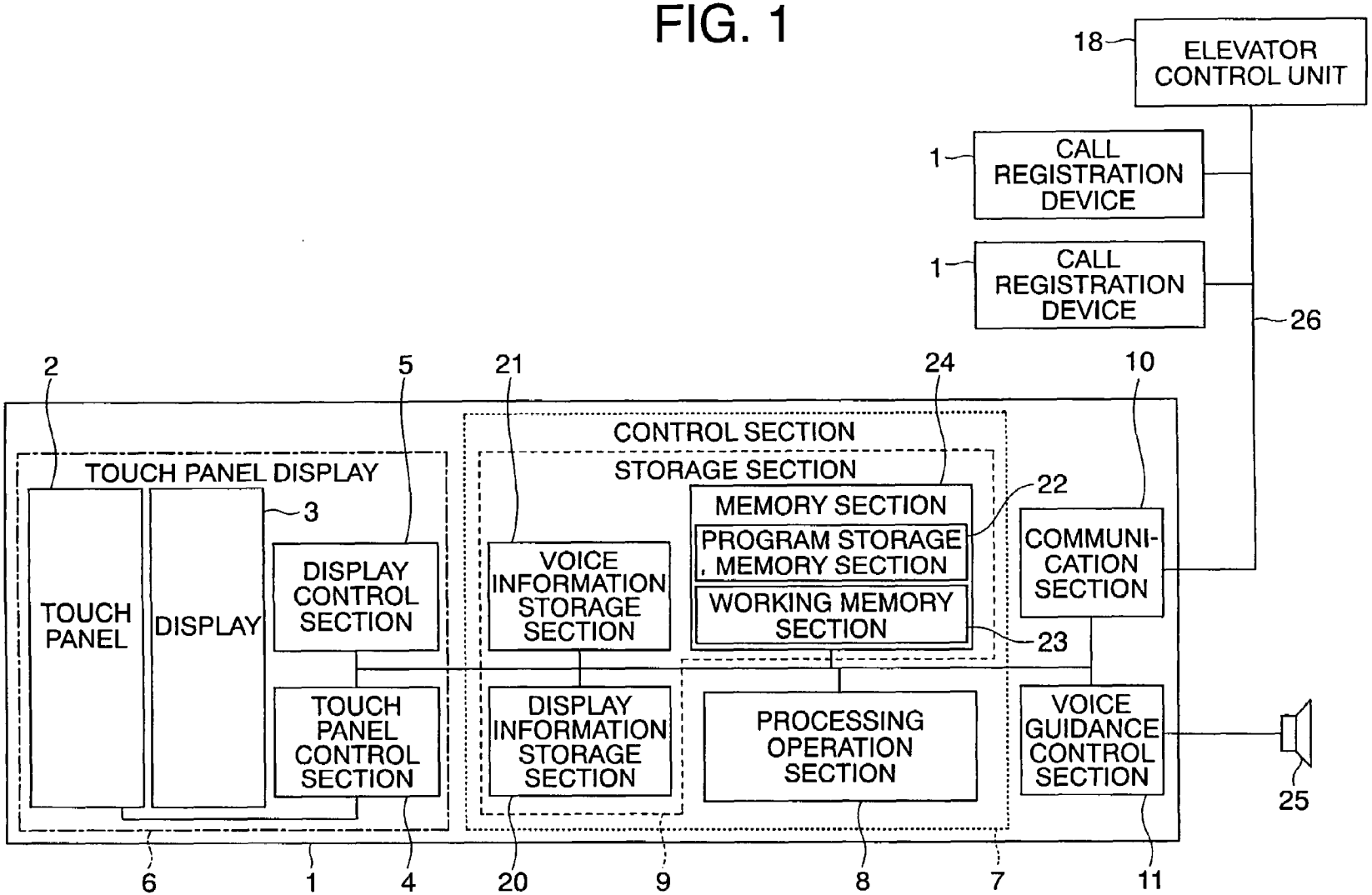
FIG. 1 is an overall configuration view of one example of an elevator call registration system according to the present invention.
Figure 2:
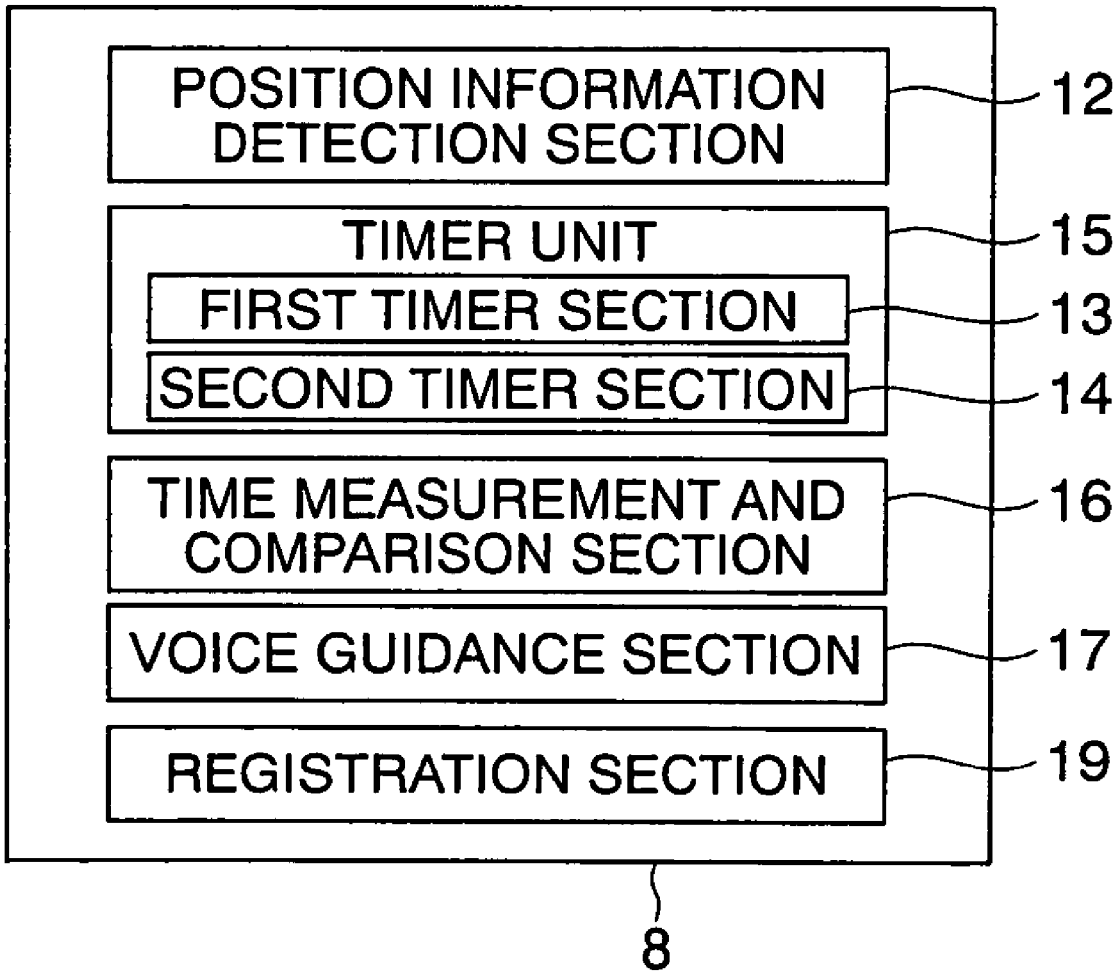
FIG. 2 is a configuration view of a processing operation section of FIG. 1.
Figure 3:
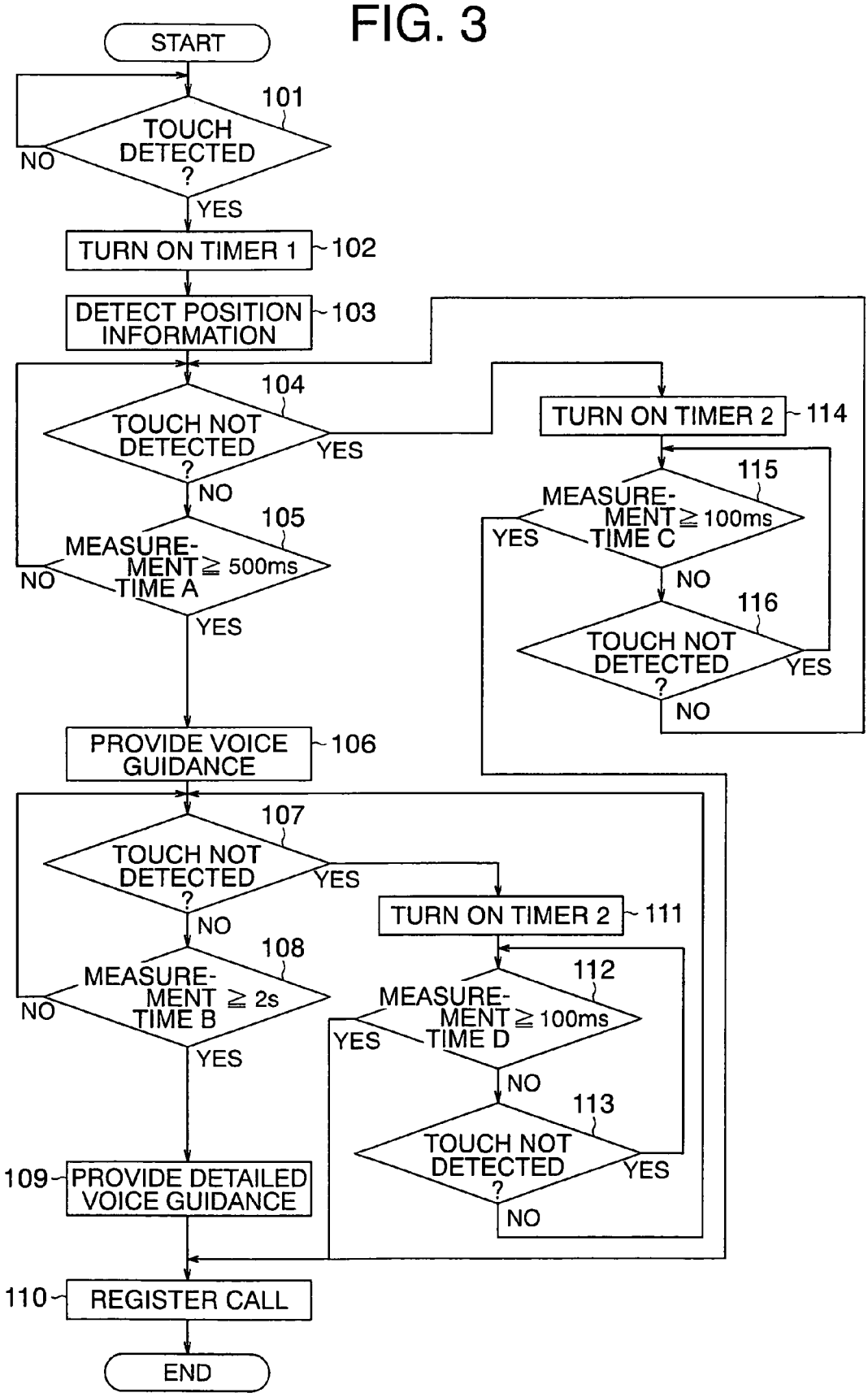
FIG. 3 is a flow chart of the operation sequence of an elevator call registration system according to a first embodiment of the present invention.

FIG. 1 is an overall configuration view of an elevator call registration system of the present invention. FIG. 2 is a configuration view of a processing operation section of FIG. 1. FIG. 3 is a flow chart of the operation sequence of the elevator call registration system according to a first embodiment of the present invention.

In each of call registration devices 1, a touch panel control section 6 includes a touch panel 2 that is adapted to be operated by a user, a display 3 that serves to display a panel screen of this touch panel, and a touch panel control section 4 and a display control section 5 that control these touch panel and display, respectively. A communication section 10 communicates call registrations and the like to an elevator control unit 18 through a communication path 26. A voice guidance control section 11 provides voice guidance through a speaker 25.

A control section 7 serves to control the touch panel display 6, the communication section 10 and the voice guidance control section 11, and includes a processing operation section 8 and a storage section 9 that perform display control of the touch panel display 6 as well as voice guidance and elevator car call registration in accordance with inputs to these touch panel display, communication section and voice guidance control section.

The processing operation section 8 includes a position information detection section 12 that detects a touch or contact position of a user with respect to the touch panel 2. A timer unit 15 includes a first timer section 13 that counts or measures time in synchronization with the start of a touch or contact of the user to the touch panel 2, a second timer section 14 that counts or measures time in synchronization with the end of the user's touch or contact to the touch panel 2, a time measurement and comparison section 16 that compares the count value of the first timer section 13 or the second timer section 14 with a prescribed time limit, a voice guidance section 17 that makes the voice guidance control section 11 provide voice guidance in correspondence to the user's touch or contact position thus detected, and a call registration section 19 that registers a call corresponding to the detected touch or contact position into the elevator control unit 18 through the communication section 10.

The storage section 9 includes a display information storage section 20 that stores information on graphics or pictures to be displayed on the display 3, a voice information storage section 21 that stores voice information to be used by the voice guidance control section 11, and a memory section 24 having a program storage memory section 22 and a working memory section 23 for the processing operation section 8.

The voice guidance section 17 serves to read voice information from the voice information storage section 21, controls the voice guidance control section 11, and broadcasts and guides the voice information by the use of the speaker 25. In addition, the call registration section 19 registers an elevator car call into the elevator control unit 18 via the communication section 10 based on the touch or contact position information detected by the position information detection section 12.

Here, note that the storage section 9 may be any kind of storage devices or storage elements such as a hard disk drive, a nonvolatile memory, or a memory requiring aperiodic write and hold operation, etc., or its some components may be constituted as the same storage device or element.

The processing operation section 8 operates based on the programs stored in the program storage memory section 22 while using the working memory section 23. In addition, the timer unit 15 may be constituted by software or hardware.

The processing operation section 8 takes or reads out display information to be displayed on the display 3 from the display information storage section 20, and sends it to the touch panel control section 5. The display information includes display coordinates and a display content. The touch panel control section 5 displays the display content in an area of the display 3 corresponding to the display coordinates based on the display information. The touch panel 2 is arranged on the front side with respect to the user of the display 3, with the display coordinates of the display 3 being made to coincide with the touch or contact coordinates of the touch panel 2. The user can input a desired operation content into the call registration device 1 by conducting a desired operation displayed on the display 3, such as for example by touching or contacting an area of the touch panel 2 corresponding to an area of the display 3 in which the desired display content is displayed among display contents such as floor numbers related to the registration of a destination floor. When the user touches the touch panel 2, the touch panel control section 4 sends an event of the touch panel 2 having been touched as well as the touch coordinates of the touch panel 2 thus touched to the processing operation section 8. Also, the touch panel control section 4 sends information on the end of the user's touch or contact to the processing operation section 8. The processing operation section 8 compares the touch coordinates thus sent with the display coordinates of the information displayed on the display 3, determines what the operation content selected by the user is, provides, as necessary, voice guidance through the speaker 25, and registers the operation content thus determined in the elevator control unit 18. The voice guidance section 11 reads out voice information corresponding to the display coordinates and the touch coordinates from the voice information storage section 21, and lets it be broadcast and guided by the speaker 25 in the voice guidance control section 11.

The working memory section 23 stores therein 500 milliseconds, 2 seconds, and 100 milliseconds as a first time limit, a second time limit, and a third time limit, respectively. These time limits are set to the typical values for the sake of explanation, but they are not necessarily limited to these values.

One or more call registration devices 1 are installed in each hall and each car, respectively, and connected to the elevator control unit 18 through the communication path 26, so that the control corresponding to an operation conducted by a user is notified to the elevator control unit 18 through the communication path 26.

The elevator control unit 18 allocates or dispatches elevator cars in accordance with an operation input such as, for instance, a call registration.

Next, reference will be made to the operation of the elevator call registration system of FIG. 1. In step (hereinafter referred to simply as S) 101, the touch panel control section 4 detects the presence or absence of a user's touch or contact to the touch panel 2. When the touch or contact is present, the presence of the touch or contact is sent to the processing operation section 8, and the control flow advances to S102, whereas when absent, a return is performed to S101.

In S102, the processing operation section 8 makes the first timer section 13 of the timer unit 15 start counting or measuring time in synchronization with the presence of the touch or contact sent from the touch panel control section 4.

In S103, the position information detection section 12 detects the contact coordinates of an area in which the touch panel 2 has been touched or contacted, and obtains information of the contact coordinates.

In S104, the time measurement and comparison section 16 determines whether the touch or contact is continued. When the touch or contact is continued, the control flow advances to S105, whereas when the touch or contact is interrupted, the control flow advances to S114.

In S105, the time measurement and comparison section 16 obtains the value of the time counted or measured by the first timer section 13, assumes the thus obtained time value as a measurement time A, and determines whether the measurement time A is more than or equal to the first time limit of 500 milliseconds read out from the working memory section 23. When it is more than or equal to 500 milliseconds, the control flow advances to S106, whereas when it is less than 500 milliseconds, a return to S104 is performed. In S105, when the touch or contact is continued for a period of time more than or equal to 500 milliseconds, the time measurement and comparison section 16 makes a determination that the user is a visually handicapped person. Here, note that in an ordinary operation of an able-bodied person, the time for which the user makes touch or contact is about 300 millisecond at most.

In S106, the voice guidance section 17 reads out the voice information related to an operation content corresponding to the touch or contact coordinates of the touched or contacted area of the touch panel 2 from the voice information storage section 21, and provides voice guidance by the speaker 25 through the voice guidance control section 11.

In S107, the time measurement and comparison section 16 determines whether the touch or contact is being continued. When the touch or contact is being continued, the control flow advances to S108, whereas when the touch or contact is interrupted, the control flow advances to S111.

In S108, the time measurement and comparison section 16 obtains the count value of the first timer section 13, assumes the thus obtained time value as a measurement time B, and determines whether the measurement time B is more than or equal to the second time limit of 2 seconds read out from the working memory section 23. When it is more than or equal to 2 seconds, the control flow advances to S109, whereas when it is less than 2 seconds, a return is performed to S107. If the usual name of a destination floor such as, for example, "fourth floor" is guided by voice, the touch or contact generally ends in about 1 second. Accordingly, when the touch or contact is continued for a period of time of 2 seconds or more, it is determined that the user expects further detailed guidance.

In S109, the voice guidance section 17 reads more detailed voice information related to an operation content corresponding to the touch or contact coordinates of the touched or contacted area of the touch panel 2 from the voice information storage section 21, and provides voice guidance by the speaker 25. For example, it is the guidance of the destination floor ("children's clothing department", "dining room floor", etc.).

In S110, the call registration section 19 sends information on user's destination floor or the like to the elevator control unit 18 via the communication path 26, and completes the call registration.

On the other hand, when the detection of the touch or contact is lost or interrupted in S104, the control flow advances to S114 where the timer unit 15 starts counting or measuring time by the second timer section 14.

In S115, the time measurement and comparison section 16 obtains the count value of the second timer section 14, assumes the thus obtained time value as a measurement time C, and determines whether the measurement time C exceeds the third time limit of 100 milliseconds read out from the working memory section 23. When it exceeds 100 milliseconds, the control flow advances to S110, whereas when it is below 100 milliseconds, the control flow advances to S116.

In S116, the touch panel control section 4 detects user's touch or contact to the touch panel 2. When the touch or contact is detected, the presence of the touch or contact is sent to the processing operation section 8, and a return to S104 is carried out. On the other hand, when the touch or contact is not detected, a return to S115 is carried out. The processes in steps S116 through S114 are based on the assumption that the user stops touching or contacting unintentionally, or user's finger comes off the touch panel 2 by mistake, and hence when the user makes touch or contact again within 100 milliseconds, the operation is continued without performing control.

Moreover, when the detection of the touch or contact disappears or is lost after the voice guidance has been given in S106, the second timer section 14 is then turned on in S111.

In S112, the time measurement and comparison section 16 obtains the value of the time counted or measured by the second timer section 14, assumes the thus obtained time as a measurement time D, and determines whether the measurement time D exceeds the third time limit of 100 milliseconds read out from the working memory section 23. When 100 milliseconds is exceeded, the control flow advances to S110, whereas when 100 milliseconds is not exceeded, the control flow advances to S113.

In S113, the touch panel control section 4 detects user's touch or contact to the touch panel 2. When the touch or contact is detected, this information is sent to the processing operation section 8, and a return to S107 is performed, whereas when the touch or contact is not detected, a return to S112 is performed. The processes in steps S111 through S113 are based on the assumption that the user stops touching or contacting unintentionally, or user's finger comes off the touch panel 2 by mistake, and hence when the user makes touch or contact again within 100 milliseconds, the operation is continued without performing control.

Such an elevator call registration system determines the operation of a visually handicapped person by the time related to the operation, so it is possible to provide services in a smooth manner by giving voice guidance as well as detailed voice guidance.

In addition, since voice guidance is provided only when it is determined that the user is a visually handicapped person, no voice guidance flows in the case of use by an able-bodied person.

Moreover, even if the user touches the touch panel or stops touching it, voice guidance does not flow unless a predetermined time has elapsed therefrom.

Embodiment 2

Figure 4:
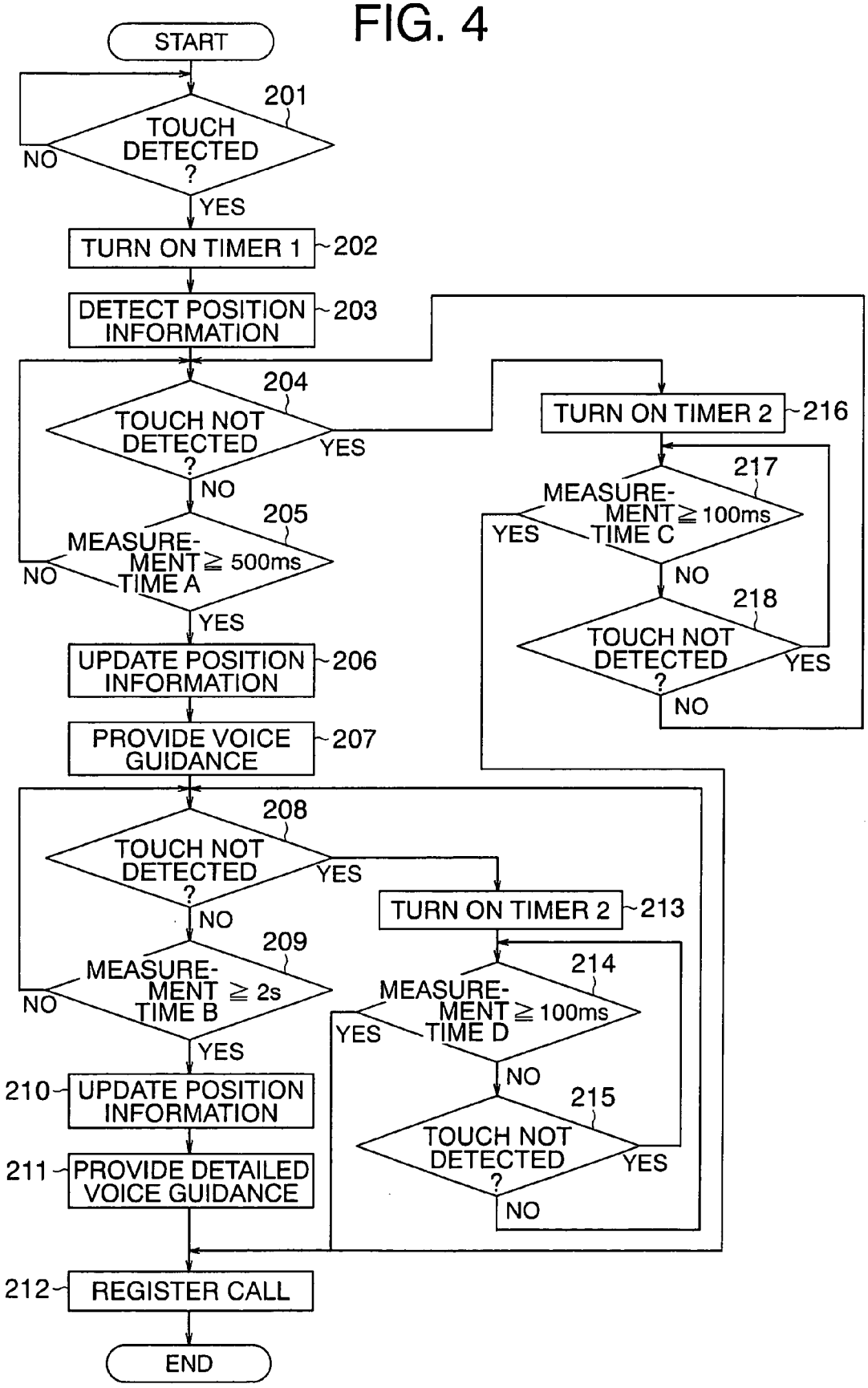
FIG. 4 is a flow chart of the operation sequence of an elevator call registration system according to a second embodiment of the present invention.

FIG. 4 is a flow chart of the operation sequence of an elevator call registration system according to a second embodiment of the present invention. FIG. 4 includes updating of location information added to FIG. 3.

Step (hereinafter referred to as S) 101 through S105 in FIG. 3 are the same as S201 through S205 in FIG. 4, S107 through S108 are the same as S208 through S209, S110 is the same as S212, and S111 through S116 are the same as S213 through S218, respectively.

Next, reference will be made to only those steps of FIG. 4 which are different from the steps of FIG. 3. In S206, after a time duration longer than or equal to the first time limit of 500 milliseconds has elapsed from the start of user's touch or contact, the position information detection section 12 detects the touch or contact coordinates of an area of the touch panel 2 touched or contacted by the user, and in S202, it updates the touch or contact coordinates information thus detected.

In S207, based on the thus updated touch or contact coordinates information, the voice guidance section 17 reads out the voice information related to an operation content corresponding to the above-mentioned area of the touch panel 2 from the voice information storage section 21, and provides voice guidance by the speaker 25.

In addition, in step S210, after the second time limit of 2 seconds or more has elapsed from the start of the touch or contact, the position information detection section 12 detects the touch or contact coordinates of the area of the touch panel 2 touched or contacted by the user, and updates the touch or contact coordinates information previously updated in S206.

In S211, based on the thus updated touch or contact coordinates information, the voice guidance section 17 reads out detailed voice information related to the operation content corresponding to the touch or contact coordinates of the touched or contacted area of the touch panel 2 from the voice information storage section 21, and provides detailed voice guidance by the speaker 25.

Since such an elevator call registration system updates the location information of a time point at which a user has completed his or her operation, the user does not recognize an area to be operated by mistake.

INDUSTRIAL APPLICABILITY

Since an elevator call registration system according to the present invention is provided with a touch panel display, a variety of operation contents are able to be guided to able-bodied persons, and at the same time appropriate operation contents are also able to be provided to visually handicapped persons through voice guidance. In addition, noise associated with voice guidance is limited, so an elevator hall can be installed in a place facing a living room.

The invention claimed is:

1. An elevator call registration system which is equipped with a touch panel display serving for call registration in accordance with a touch position thereon, and a processing operation section for registering an elevator call into an elevator control unit based on an operation of a user on said touch panel display, characterized in that said processing operation section comprises:

a position information detection section that detects the position of a touch of the user to said touch panel display;

a timer unit having a first timer section that counts time from the start of the touch to said touch panel display;

a time measurement and comparison section that compares a count value of said first timer section with a prescribed time limit;

a voice guidance section that serves to provide voice guidance related to said touch position detected after the time of the touch to said touch panel display exceeds said prescribed time limit; and a call registration section serving to register a call corresponding to said detected touch position into said elevator control unit when the time of the touch to said touch panel display is shorter than said time limit, and said call registration section also registering, after said voice guidance has been given, a call corresponding to said detected touch position into said elevator control unit when said time of the touch is longer than said time limit.

2. The elevator call registration system as set forth in claim 1, characterized in that said time measurement and comparison section compares the count value of said first timer section with a prescribed first time limit and a prescribed second time limit that is longer than said first time limit, respectively; and said voice guidance section serves to provide voice guidance after said first time limit has elapsed from the start of said touch, and then provide detailed voice guidance after said second time limit has elapsed from the start of said touch.

3. The elevator call registration system as set forth in claim 2, characterized in that said timer unit further includes a second timer section that counts time from the end of the touch to said touch panel display; and said time measurement and comparison section compares the count value of said second timer section with a prescribed third time limit, and makes a determination that the touch to said touch panel display is continued, when the touch is restarted within said third time limit from the end of said touch.

4. The elevator call registration system as set forth in claim 1, characterized in that said timer unit further includes a second timer section that counts time from the end of the touch to said touch panel display; and said time measurement and comparison section compares the count value of said second timer section with a prescribed third time limit, and makes a determination that the touch to said touch panel display is continued, when the touch is restarted within said third time limit from the end of said touch.

5. The elevator call registration system as set forth in claim 1, characterized in that said time measurement and comparison section detects and updates the touch position on said touch panel display being touched after said time limit has elapsed from the start of said touch; and said voice guidance section provides voice guidance of an operation related to said updated touch position.

6. The elevator call registration system as set forth in claim 2, characterized in that said time measurement and comparison section detects and updates the touch position on said touch panel display being touched after said second time limit has elapsed from the start of said touch; and said voice guidance section provides detailed voice guidance of an operation related to said updated touch position.

* * * * *